United States Patent [19]

Wicks, Sr.

[11] Patent Number: 4,601,503

[45] Date of Patent: Jul. 22, 1986

[54] DOOR SECURITY DEVICE

[76] Inventor: Jerome L. Wicks, Sr., 3401 Rockdale Ct., Baltimore, Md. 21207

[21] Appl. No.: 542,488

[22] Filed: Oct. 17, 1983

[51] Int. Cl.[4] ..... E05C 19/00

[52] U.S. Cl. ..... 292/259 R

[58] Field of Search ..... 292/259, 268, 272, 278

[56] References Cited

U.S. PATENT DOCUMENTS

| | | | |
|---|---|---|---|
| 924,277 | 6/1909 | Saphier | 292/259 R |
| 3,592,497 | 7/1971 | Logan | 292/259 R |
| 3,971,582 | 7/1976 | Walker | 292/259 R |
| 4,067,598 | 1/1978 | Mansour | 292/259 R |
| 4,429,911 | 2/1984 | O'Neal et al. | 292/259 R |
| 4,462,625 | 7/1984 | Barnhill | 292/259 R |

FOREIGN PATENT DOCUMENTS

| | | | |
|---|---|---|---|
| 77682 | 10/1894 | Fed. Rep. of Germany | 292/259 R |

*Primary Examiner*—Robert L. Wolfe

*Assistant Examiner*—Russell W. Illich

[57] ABSTRACT

The invention is an improved device for securing doors against break-in, even when the door is unlocked. The invention consists of a hasp-like retainer member, an eye-type retainer member, and a bar-like security piece of rectangular cross-section. The retainer members are affixed to a wall or door casing on each side of the doorway of the door to be secured at approximately the mid-height of the door. The hasp-like retainer, which is hinge-like in operation, may be folded back against the wall or the door casing when not in use. When in use the hasp-like end is opened to a position generally perpendicular to the face of the wall of the casing. The bar-like security piece, being of a cross-sectional area that is slightly less than the opening in the hasp-like end of the retainer, and of a configuration that will fit into the hasp-like slot, is inserted into the hasp-like retainer member with the opposite end secured to the eye-type retainer member.

6 Claims, 1 Drawing Figure

DOOR SECURITY DEVICE

BACKGROUND AND SUMMARY OF THE INVENTION

The invention relates to protective and security measures for buildings and in particular to the securing of doors against break-in or unauthorized entry. Specifically, the invention provides security against the opening of a door inwardly for unauthorized purposes.

In the prior art there are numerous ways in which doors have been secured against entry from the outside in addition to the normal door lock. There have been bolts of various types, extra interior locks, so-called keeper chains, locked chains that pass through a door handle and an available eye or similar opening, and the old fashioned bar dropped into a "U" shaped retainer or similar configuration on each side of the doorway, as well as other devices. In some cases where the door could be opened slightly if unlocked, the security means could be conveniently cut or pushed to one side or upward to disengage it and permit entry.

The present invention overcomes these problems and provides a device that is easy to install, simple to be placed in operation to secure a door, even when unlocked, and yet permits opening the door slightly for conversation without the ability of the outsider to disengage the device.

The present invention provides a hasp-like retainer member which is affixed to a wall or door frame casing on one side of the doorway, and an eye-type on the other side of the doorway opening. A bar-like member or security piece of a rectangular cross-section configured to be affixed to the hasp-like retainer member and to the eye-type retainer member is another component of the security device.

The retainer members may be suitably affixed to a wall or door frame casing on each side of the door, depending on the building structure. The hasp-like retainer member may be affixed to the interior wall or door frame by regular screws, one-way screws, lag screws, bolts, welding, or by any other similar satisfactory manner so long as the affixation is sufficient for the job to be done. When not in use the hasp-like retainer member may be folded to the closed position and the bar-like member may be left hanging from the eye-type retainer.

It is to be noted that the invention is intended for use on an outside door, such doors that open into the inside of the building and swing into the interior room.

It is also to be noted that the invention may be used on interior doors that open inwardly into a room.

In use, the slotted end of the hasp-like retainer is positioned so that it extends into the room area perpendicular to the wall or door frame to which it is affixed.

The security piece or bar-like member, which is affixed to the eye-type retainer, is then removably affixed to a slot-like configuration of the hasp-like retainer and positioned so that the bar-like member extends across the door and blocks it from being opened.

When the bar-like member is to be removed so that the door can be opened, the bar-like member is removed from the slot-like configuration of the hasp-like retainer and left hanging downwardly on the eye-type retainer.

If necessary, the door may be opened until the edge of the door presses against the bar-like member. This will permit a crack-like opening for conversation and observation before entry is permitted.

It is, therefore, an object of this invention to provide a security means for an exterior door.

It is another object of the invention to provide a security means for a door that opens inwardly into the building or into a room.

It is also an object of the invention to provide a security means for a door that may be an interior door that opens inwardly into a room.

It is a further object of the invention to provide a security means for a door that has the components so arranged so as to prevent the security device from being removed from its securing means by persons on the exterior of the door.

Further objects and advantages of the invention will become more apparent in light of the following description of the preferred embodiments.

DESCRIPTION OF THE PREFERRED EMBODIMENTS

Figure 1:
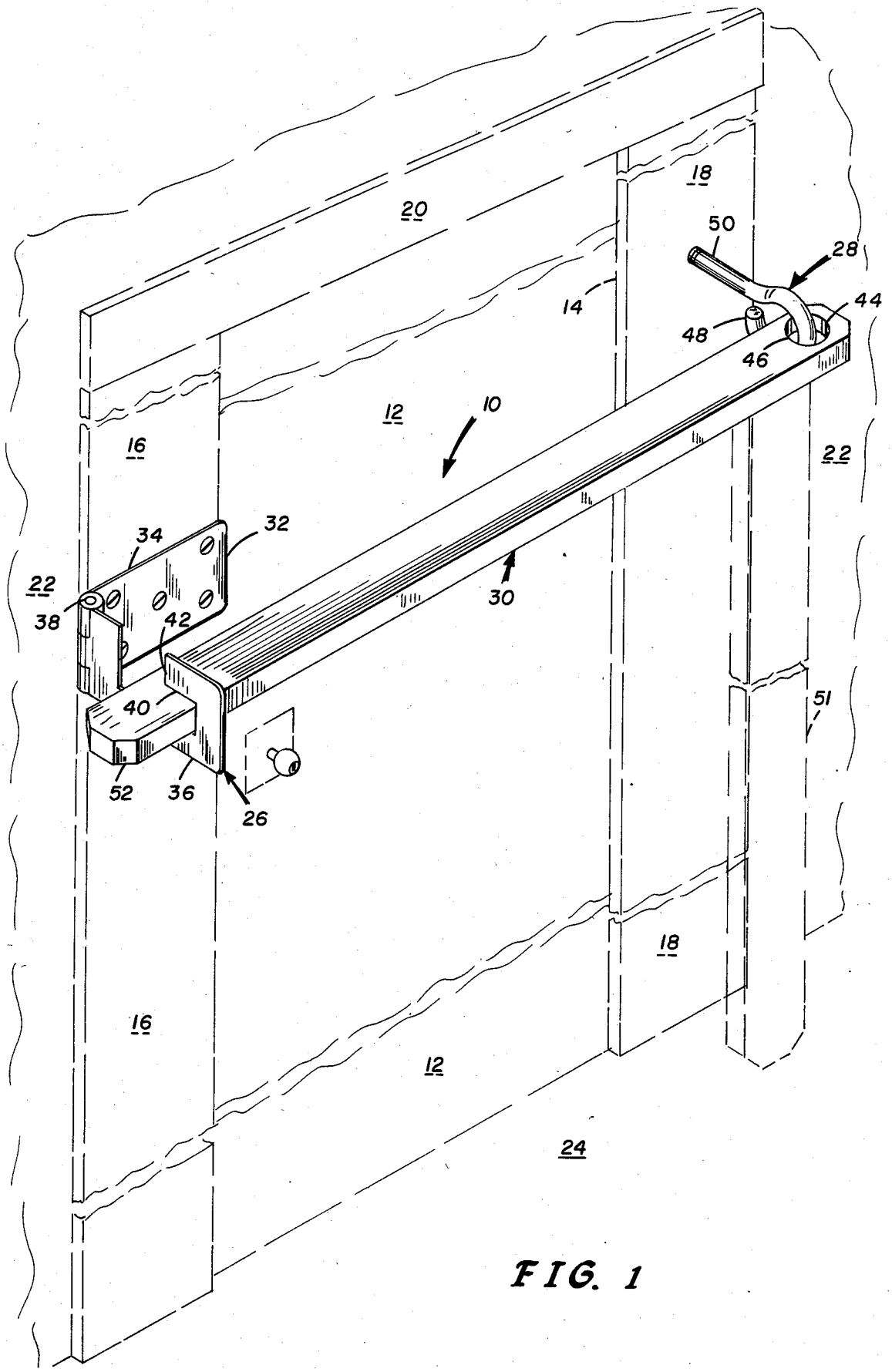
FIG. 1 is a perspective view of a door security device.

Referring now to the drawings, FIG. 1 is a perspective view of a door security device 10 for a door 12.

The door security device 10 is on the inside of a door 12 opening into the room where the door security device 10 is located.

The door 12, the door framing 14, 16, 18 and 20, and the wall 22, at the floor 24 are all shown in phantom lines. The door framing consists of the door jamb 14, left casing 16, right casing 18, and the header 20.

The door security device 10 is positioned on the interior side of the door at approximately the mid point of the door height.

The door security device consists of a left hasp-like retainer means 26, a right eye-type retainer means 28, and a bar-like security means 30.

The hasp-like retainer means 26 and the eye-type retainer means 28 are affixed to the door frame casings 16 and 18, respectively, with a plurality of fastening means 32 being used for the hasp-like retainer means 26, and the eye-type retainer means having a screw-type end 50 thereon for affixing to the door frame casing 18. It is to be noted that fastening means 32 may be regular screws, one-way screws, lag screws, bolts, welding (if on a metal frame), or any other suitable and secure means of fastening. If the frame is metal the screws may also be machine screws. These variations of fastening means 32 are within the scope and intent of the invention.

An alternative, if there isn't any framing around the door opening, is to fasten the hasp-like retainer means 26 and the eye-type retainer means 28 to the wall 22, by similar securing means as aforementioned for a door frame.

The hasp-like retainer means 26 is suitably drilled, punched, or formed to receive the plurality of fastening means 32 when affixed to the frame casing 16 or to the wall 22. The eye-type retainer means 28 is a screw-eye type component that has an integral screw thread 50 on the end thereof.

The hasp-like retainer means 26 is constructed of two parts, a fastener portion 34 and an elongated slotted portion 36, with both suitably hinged 38 together. The slotted portion 36 of retainer means 26 has an "L"

shaped entry slot consisting of an elongated slot 40 more or less centrally located therein, with the upstanding leg 42 of the "L" shaped entry slot providing an open entry means in the slotted portion 36 to the elongated slot 40.

The bar-like security means 30 is rectangular in cross-section and configured and sized so as to removably pass through the open upstanding leg 42 and into the elongated slot 40. Note that when the bar-like security means 30 is in place within the elongated slot 40 it is so positioned so that the horizontal cross section axis of the bar-like security means 30 is in a maximum strength position relationship to the door 12. The eye portion 48 of the eye-type retainer means 28 loops through the aperture 44 in one end of the bar-like security means 30. In effect the bar-like security means 30 blocks the door 12 from opening. The aperture 44 has a counter-sink 46 on each side of the bar-like security means 30 to facilitate the turning of the bar-like security means 30 on the eye portion 48 when the bar-like security means 30 is being passed through the opening upstanding leg 42 and into the elongated slot 40.

The bar-like security means 30 hangs downwardly 51 on the eye-type retainer means 28 when not in use. The four corners 52 may be chamfered or cut off to eliminate sharp corners and to facilitate turning at the eye-type retainer means 26 to the downwardly hanging 50 position.

It is to be noted and understood that a bar-like security means 30 without a counter-sink on one or both sides of the aperture 44 is within the scope and intent of the invention.

When the bar-like security means 30 is to be removed from the elongated slot 40 so that the door 12 may be opened, the bar-like security means 30 is turned and lifted through and out of the open upstanding leg 42. As the bar-like security means 30 is turned, as mentioned hereinbefore, the opposite end of the bar-like security means 30 concurrently pivots and slides around on the eye portion 48 through the aperture 44 in the end of the bar-like security means 30.

The bar-like security means 30 may be steel, aluminum, or any other suitable material of sufficient strength for the purpose, and may be solid, hollow, or fabricated as long as it has the sufficient strength required. All such variations are within the scope and intent of the invention.

As can be readily understood from the foregoing description of the invention, the present structure can be configured in different modes to provide the ability to secure a door.

Accordingly, modifications and variations to which the invention is susceptible may be practiced without departing from the scope and intent of the appended claims.

What is claimed is:

1. A security device, comprising:

an enclosure, said enclosure having an interior and an exterior and an aperture-like opening therein, said aperture-like opening in said enclosure communicating said interior of said enclosure with said exterior thereof, said aperture-like opening having a covering means, said covering means requiring protective security measures thereon;

a first retaining means, said first retaining means having an integral and monolithic fastening means thereon, said integral and monolithic fastening means affixing said first retaining means to said interior of said enclosure at said aperture-like opening therein, said first retaining means having a first portion and a second portion, said first portion being integral and monolithic with said second portion, said first portion including an eye portion of generally circular configuration, said second portion of said first retaining means being screw threaded in configuration, said first retaining means being screw-eye-like in general configuration, said screw threaded second portion of said first retaining means suitably affixing said first retaining means in place of said aperture-like opening;

a second retaining means, said second retaining means having a first portion and a second portion, said first portion of said second retaining means including a hinge affixed to said second portion thereof, said second portion including a hinged edge and a top edge transverse to said hinged edge, said second retaining means being hasp-like in general configuration, said first portion of said second retaining means having a plurality of apertures therein and therethrough, said plurality of apertures in said first portion of said second retaining means being suitable for affixing said second retaining means to and at said aperture-like opening, said second portion of said second retaining means having an elongated "L" shaped slot therein and therethrough, said slot comprising a first upstanding leg intersecting said top edge and a second leg transverse to said first leg;

a bar-like member, said bar-like member being pivotally affixed to said first retaining means so as to be pivotable in more than one axis of direction and removably affixed to said second retaining means, said bar-like member having an aperture in and through and spaced from one end thereof, said eye portion of said first retaining member being the means of pivotally affixing said bar-like member thereto through said aperture therein, said "L" shaped slot in said second portion of said second retaining means being oriented horizontally to receive said bar-like member so that said bar-like members cross-sectional long axis is horizontal in said horizontally oriented "L" shaped slot, said bar-like member having a cross-sectional configuration that can be removably inserted into said elongated "L" shaped slot, said bar-like member being oriented in said "L" shaped slot so as to be in a maximum strength position in relation to said covering means, said bar-like member having a length; and a plurality of fastening means, said plurality of fastening means affixing said second retaining means to said interior of said enclosure at said aperture-like opening therein, said plurality of fastening means being inserted in and through said plurality of apertures in said first portion of said second retaining means to affix said second retaining means to and at said aperture-like opening.

2. A security device as recited in claim 1, wherein said enclosure is a room-like enclosure, said aperture-like opening therein is a doorway, said covering means is a door, said door being hinged to open inwardly into said interior of said room-like enclosure, said first and second retaining means affixed at said aperture-like opening being arranged with said first retaining means on one side thereof and said second retaining means on the opposite side thereof.

3. A security device as recited in claim 1, wherein said first and second retaining means are located and situated and affixed one on each side of said aperture-like opening in said enclosures, said hingedly affixed second portion of said second retaining means being positioned to stand and extend substantially at a right angle to said first portion thereof, said bar-like member having been inserted into said "L" shaped slot in said second portion of said second retaining means and positioned so that said length thereof extends from said first retaining means to said second retaining means so as to effectively block said opening of said enclosure.

4. A security device as recited in claim 1, wherein said bar-like member has a rectangular cross-section, said aperture spaced from one end of said bar-like member having a counter-sink in one side of said bar-like member.

5. A security device as recited in claim 1, wherein said bar-like member has a rectangular cross-section, said aperture spaced from one end of said bar-like member having a counter-sink in both sides of said bar-like member.

6. A security device as recited in claim 2 and additionally a frame means, said frame means being suitably affixed around said opening and on the inside surface of said enclosure, said first and second retaining means being affixed to said frame means.

* * * * *